US005150756A

United States Patent [19]

Hassanzadeh

[11] Patent Number: 5,150,756

[45] Date of Patent: Sep. 29, 1992

[54] WELL COMPLETION APPARATUS

[75] Inventor: Hedayat H. Hassanzadeh, Houston, Tex.

[73] Assignee: Davis-Lynch, Inc., Pearland, Tex.

[21] Appl. No.: 660,708

[22] Filed: Feb. 25, 1991

[51] Int. Cl.[5] ..... E21B 34/10

[52] U.S. Cl. ..... 166/318; 166/319; 166/242

[58] Field of Search ..... 166/318, 317, 319, 332, 166/291, 242; 175/61, 62

[56] References Cited

U.S. PATENT DOCUMENTS

| | | | |
|---|---|---|---|
| 3,005,507 | 10/1961 | Clark, Jr. et al. | 166/319 X |
| 3,526,280 | 9/1970 | Aulick | 166/285 |
| 3,768,556 | 10/1973 | Baker | 166/154 |
| 3,789,926 | 2/1974 | Henley et al. | 166/224 |
| 4,260,017 | 4/1981 | Nelson et al. | 166/154 |
| 4,469,174 | 9/1984 | Freeman | 166/318 X |
| 4,574,894 | 3/1986 | Jadwin | 166/319 X |
| 4,842,062 | 6/1989 | Schneider et al. | 166/154 |
| 4,949,788 | 8/1990 | Szarka et al. | 166/285 |

OTHER PUBLICATIONS

World Oil "Extended Reach Drilling For Shallow Oil And Gas Wells" Oct. 24-26, 1990-R. M. Hinkle-Unocal Oil And Gas-M. G. Mims-K & M Enterprises-6 pages-Gulf Publishing Company.

*Primary Examiner*—Terry Lee Melius
*Attorney, Agent, or Firm*—Vaden, Eickenroht, Thompson, Boulware & Feather

[57] ABSTRACT

There is disclosed apparatus for use in completing a well whose well bore has a substantially horizontally extending lower end into which a casing string is to be lowered, the apparatus including a tool adapted to be connected in the casing string and having a plug therein above a back pressure valve installed in the lower end of the string to form a buoyant chamber within the casing string which is filled with a low density fluid for lowering into the substantially horizontally extending lower end of the well bore.

4 Claims, 2 Drawing Sheets

WELL COMPLETION APPARATUS

Figure 1:
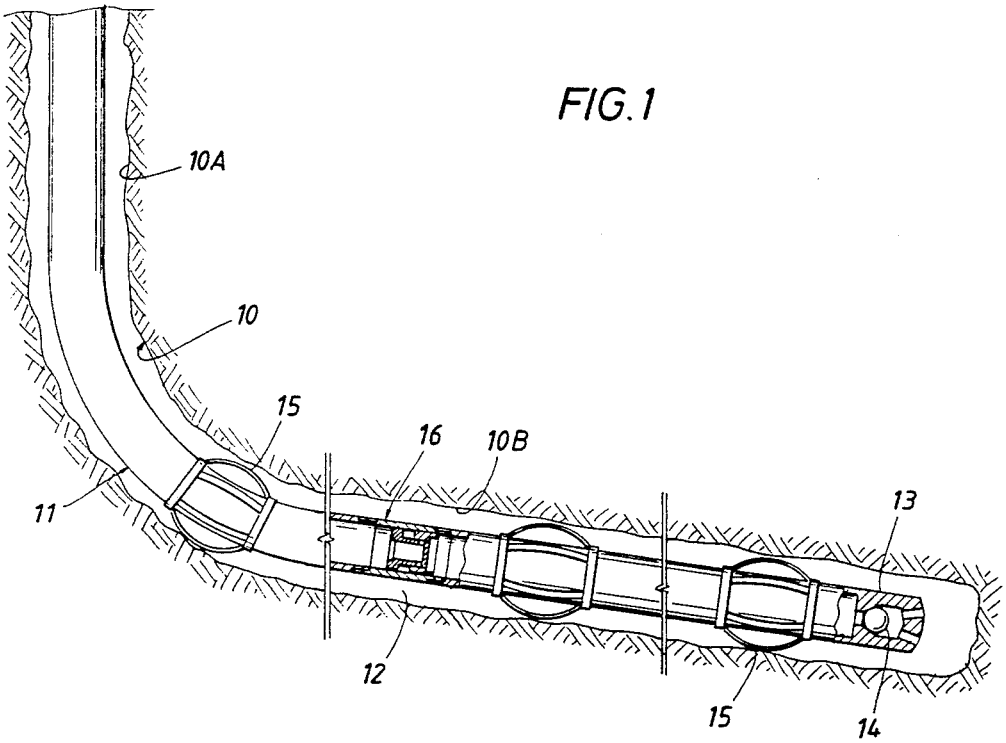

This invention relates generally to an apparatus for use in completing a well whose well bore has a substantially horizontally extending lower end into which a casing string is to be lowered. More particularly, it is relates to improvements in a tool having a plug adapted to be installed in the casing string above a back pressure valve installed in the lower end of the string to form a buoyant chamber which is filled with a low density fluid for lowering into the substantially horizontal extending lower end of the well bore during completion of the well.

In the completion of a well which is essentially vertical throughout its length, one or more casing strings are lowered into the well bore and anchored therein by a column of cement within the annulus between the string and the well bore. It is conventional practice to fill the casing string with heavy fluid such as drilling mud which prevents it from being collapsed due to the drilling mud about the outside of the casing string as it is "floated" into the well bore.

When the casing string has been lowered to full depth, a wiper plug is lowered onto the column of drilling mud within it and cement is added to the string above the wiper plug and pressurized to pump the mud out of the lower end of the string and past a float shoe or back pressure valve at its lower end, which may be one or both of a float shoe and float collar, and thus into the annulus about the string. When the plug lands on the back pressure valve, the pressure on the cement ruptures a diaphragm across it to permit the cement to circulate out the lower end of the string and into the annulus to displace the mud therein. Of course, the back pressure valve prevents the cement in the annulus from "U" tubing back into the string.

Another wiper plug may be lowered into the string to separate the cement column from the drilling mud above it. In any case, when the desired amount of cement has been pumped into the annulus, a tool is lowered into the string to drill out one or both plugs and the back pressure valve, and thus open the lower end of the string to permit inner casing strings and a tubing string to be lowered therethrough.

When the well bore has a substantially horizontal lower end, the weight of the drilling mud within the casing string may force its lower end so tightly against the lower side of the horizontal bore as to prevent it from reaching total depth. It has therefore been proposed to install a tool within the casing string which has a plug above the back pressure valve in the lower end of the string so as to separate drilling mud above it from air or other low density fluid beneath it and thereby form a flotation chamber which lightens the lower end of the casing string to facilitate its being lowered to full depth in the well bore.

A tool may then be lowered through the casing string in order to open the plug to permit an interchange of mud above it and air below it. When the mud and air have stabilized, the plug is pulled from the casing string and cement is circulated down through the casing string and into the annulus, as above described in the case of conventional essentially vertical wells. Alternatively, the plug may be drilled out to permit cement to be circulated downwardly through it. In any case, after the cement has been pumped into the annulus, the wiper plug and back pressure valve at the lower end of the casing string must also be drilled out, thus requiring a second "trip" into and out of the casing string.

The object of this invention is to provide a tool of this general type which is of such construction that the plug may be opened to permit interchange of the high and low density fluids above and below it and then drilled out with the wiper plugs and back pressure installed at its lower end without having to make more than one trip into and out of the well.

This and other objects are accomplished, in accordance with the illustrated embodiment of the present invention, by a tool of the type described which comprises a tubular member connectible in a casing string and a plug mounted in the tubular member to form a flotation chamber adapted to be lowered with the string into the substantially horizontally extending lower end of the well bore. The plug has passageway means therethrough and valve means movable between positions opening and closing the passageway, and a means is provided for holding the valve means in closed position so as to contain air or other low density fluid in the flotation chamber as the casing string is lowered into the well bore. However, the holding means is releasable in response to a predetermined increase in pressure of the high density fluid above it so as to open the passageway means and thereby permit an interchange of the fluids. More particularly, the mounting of the plug to the tubular member is releasable upon lowering of means onto the valve means to close the passageway means and in response to a predetermined increase in pressure of the high density fluid, whereby the plug and valve means may be lowered through the tubular insert and into the lower end of the casing string above the back pressure valve.

At this time, cement may be circulated downwardly out the lower end of the string and into the annulus, following which the plug and valve means may be drilled out along with the wiper plugs and back pressure valve, as above described. However, due to the above described construction of the plug and valve means, the latter may be opened without the necessity of a preliminary trip into and out of the well.

In the preferred embodiment of the invention, the valve means comprises a valve member which is mounted for vertical movement within a passageway in the plug, and a means is provided for sealing between the tubular member, plug and valve member when the valve member is in its closed position in the passageway. More particularly, the valve member has an upper end slidable within the tubular member above the plug between an upper position releasably connected to the tubular member above the plug and a lower position seated on the plug when released, and a lower end which is slidable within the passageway and has ports which are closed when the valve member is in upper position and which are open when the valve member is in its lower position.

Figure 2:
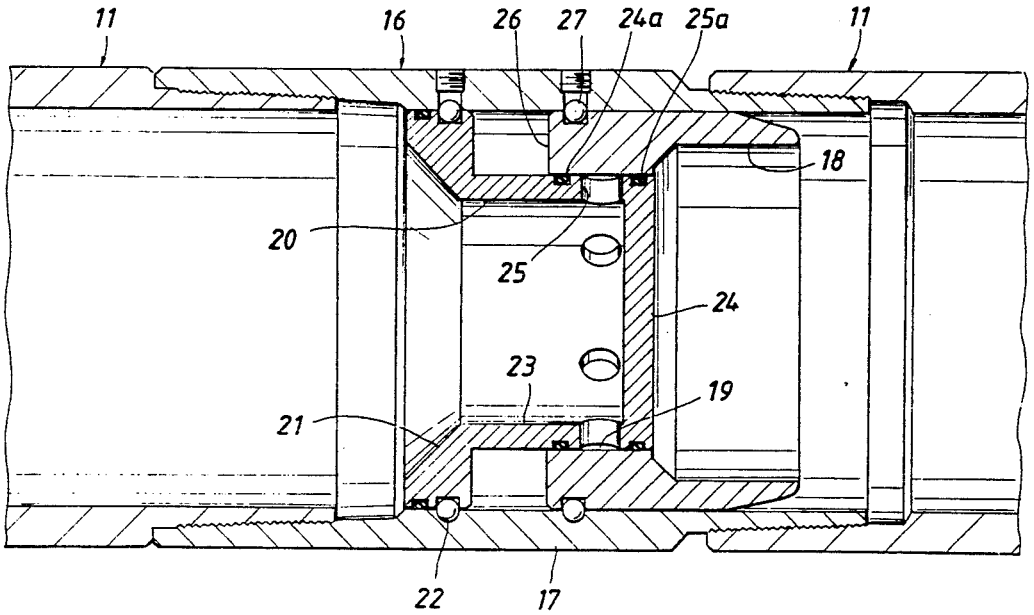
Figure 3:
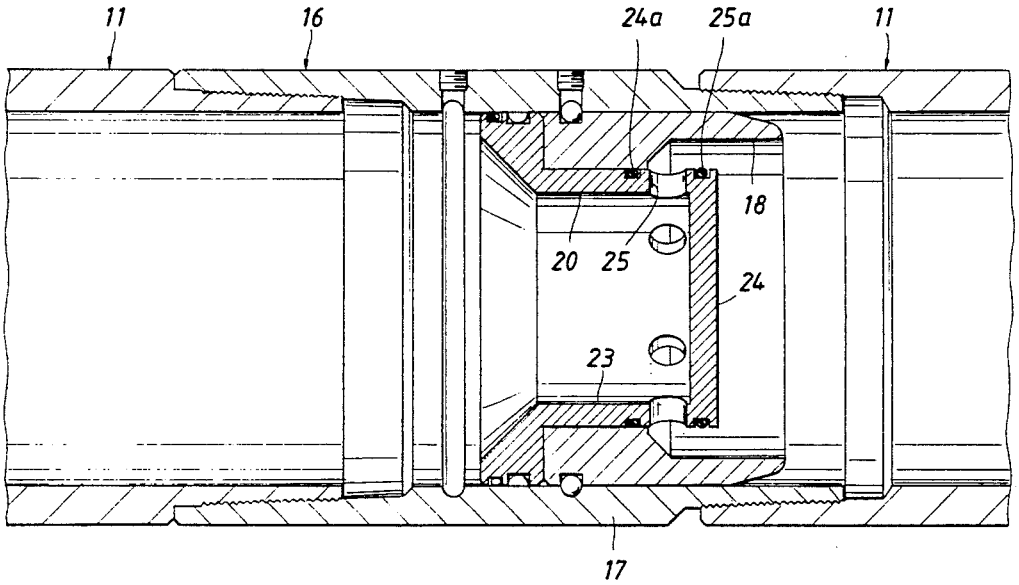
Figure 4:
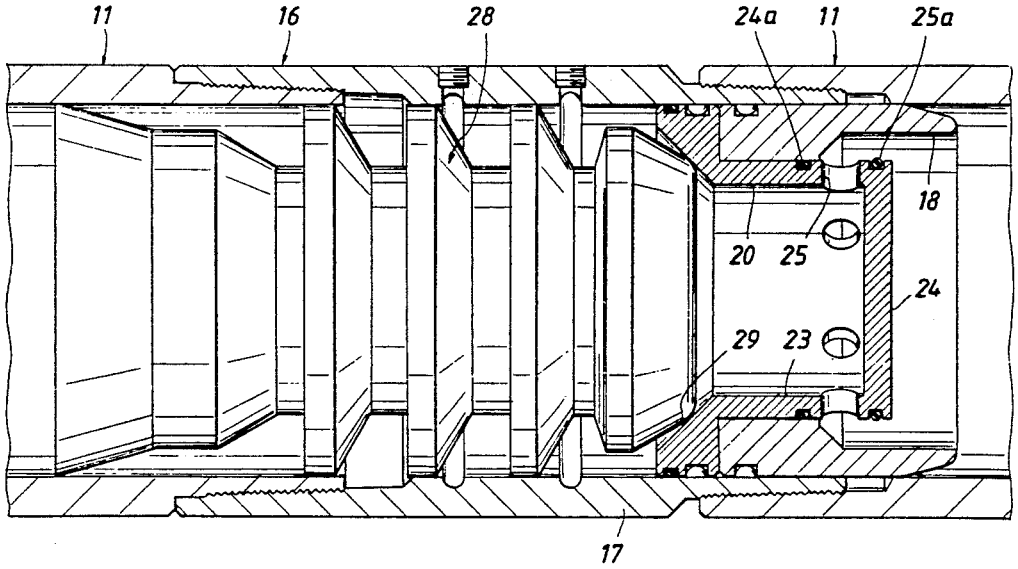

In the drawings, wherein like reference characters are used throughout to designate like parts:

FIG. 1 is a vertical sectional view of a portion of a well bore having a horizontally extending portion at its lowermost end, and showing a casing string lowered into the bore to dispose a tool installed therein and constructed in accordance with the present invention above a back pressure valve in the lower end of the string to provide a flotation chamber within the horizontally extending portion of the well bore;

FIG. 2 is an enlarged cross-sectional view of the tool with the valve member thereof shown in its closed position;

FIG. 3 is a view similar to FIG. 2, but upon release of the valve member from the tubular member and movement to its lower position opening the passageway through the plug; and FIG. 4 is another view similar to FIGS. 2 and 3, but upon lowering of a wiper plug onto the valve member and release of the plug for connection to the tubular member in response to pressure above the plug, to permit the valve member and plug to be lowered through the casing string with the wiper plug for landing on the back pressure valve at the lower end of the casing string.

With reference now to the details of the above described drawings, the well bore, which is indicated in its entirety by reference character 10 in FIG. 1, includes a substantially vertical portion 10A extending downwardly from the surface, and a substantially horizontally extending portion 10B adapted to extend from the lower end of the portion 10A into a producing formation at the lower end of the well bore. The casing string 11 which has been lowered into the well bore is of course made up of joints of casing which form an annulus 12 between the casing string and the well bore, with a back pressure 13 installed in the lower end of the casing string. As illustrated, the valve is a float shoe having a ball 14 which permits flow downwardly through the float shoe, but prevents flow upwardly into the casing string above the float shoe. Obviously, however, the back pressure valve may be a float collar or a combination of a float shoe and collar. The lower end of the casing string is held in a substantially central position within the horizontally extending portion of the well bore by means of centralizers 15 disposed about the casing string at spaced locations therealong.

The tool constructed in accordance with the present invention, and indicated in its entirety by reference character 16, is installed within the casing string above the float shoe to provide a buoyancy chamber within the horizontally extending portion of the well bore when the casing string has been lowered to full depth. The exact location of the tool within the casing string will depend upon the volume of the flotation chamber between it and thought necessary in order to facilitate lowering the string to full depth.

The tool 16 is shown to comprise a tubular member 17 threadedly connected to joints of the casing string above and below the tool to form a continuation of the casing string, and a plug 18 releasably mounted within the tubular member and having a passageway 19 therethrough to connect its upper and lower ends. The tool also includes valve means in the form of a valve member 20 which is mounted for vertical movement within the passageway between one position closing it, as shown in FIG. 2, and another position opening it, as shown in FIG. 3. When the valve member is in its closed position, it is supported from the body and separates a high density fluid above it from a low density fluid below it, thus forming a flotation chamber 21 in the casing string between the tool 16 and the float shoe 13.

In the preferred and illustrated embodiment of the invention, the valve member 20 has an upper end 21 which is slidable within the tubular member 17 and releasably held in its upper closed position by means of shearable balls 22 disposed between the valve member and the tubular member. The lower end of the valve member comprises a sleeve 23 which is closed by wall 24 at its lower end and which has ports 25 in its side near the wall 24. The sleeve 23 at the lower end of the valve member is slidable within the passageway 19 within the plug and carries seal rings 24A and 25A thereabout for sealably engaging the passageway above and below the ports 25 in the closed position of the valve member. When, however, the valve member is released from connection to the tubular member, upon shearing of the balls 22, it is lowered to a position in which the ports 25 move downwardly to a position below the passageway 19 so as to permit an interchange of the high density fluids above and below the valve member. More particularly, the valve member is located in its open position by landing of its upper end 21 upon a shoulder 26 on the upper end of the plug surrounding the passageway 19.

The plug 18 is releasably connected to the tubular member by means of shearable balls 27 extending between its outer diameter and the inner diameter of the tubular member. When the valve member has been moved to the open position of FIG. 4, and it is then desired to release the plug and valve member from the tubular member for lowering within the casing string, a wiper plug 28 may be lowered downwardly through the casing string to land upon an upwardly facing seat 29 of the upper end of the valve member, thus closing the upper end of the valve member. At this time then an increase in pressure of the fluid above the wiper plug 28 will shear the balls 27, as shown in FIG. 4, and thus permit the plug and valve member to be moved downwardly with the wiper plug.

As previously described, this then permits the valve member and wiper plug to land on the float shoe, whereby cement may be circulated downwardly through the casing string and out its lower end into the annulus, following which a tool may be lowered downwardly through the well bore to drill out the wiper plug and tool as well as the float shoe in order to continue with the well completion process.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. For use in completing a well having a well bore whose lower end extends substantially horizontally, a tool comprising a tubular member connectible in a casing string to be lowered into the lower end of the well bore and having a back pressure valve installed near its lower end, a plug having passageway means therethrough and valve means movable between positions opening and closing the passageway means, means mounting said plug within the tubular member, and means holding said valve means in closed position to separate a high density fluid thereabove from a low density fluid therebelow as the casing string is lowered into the well bore, said holding means being releasable in response to a predetermined increase in pressure of the high density fluid so as to open the passageway means and thereby permit an exchange of the fluids, and said valve means having a seat and said mounting means being releasable, upon lowering of wiper plug means onto the seat to close the passageway means and in response to a further predetermined increase in pressure of the high density fluid above the wiper plug means, whereby said plug and valve means may be lowered through the tubular member and into the lower end of the casing string.

2. For use in completing a well having a well bore whose lower end extends substantially horizontally, a tool comprising a tubular member connectible in a casing string to be lowered into the lower end of the well bore and having a back pressure valve installed near its lower end, a plug having a passageway therethrough, means connecting the plug to the tubular member, a valve member, means mounting said valve member for vertical movement between one position closing the passageway and another position supported from the plug and opening the passageway, means holding the valve member in its closed position, and means sealing between the tubular member, plug and valve member when the valve member is in its closed position to separate a high density fluid thereabove from a low density fluid therebelow as the casing string is lowered into the well bore, said holding means being releasable in response to a predetermined increase in pressure of the high density fluid to permit the valve member to be moved to its open position, said valve means having a seat and said connecting means being releasable upon lowering of wiper plug means onto the seat to close the passageway and in response to a further predetermined increase in pressure of the high density fluid above the wiper plug means, whereby said plug and valve member may be lowered through the tubular member.

3. A tool of the character defined in claim 2, wherein said valve member has an upper end slidable within the tubular member above the plug between an upper position above the plug and a lower position seated on the plug, and a lower end slidable within the passageway and having ports therein which are closed when the valve member is in its upper position and which are open when in its lower position, said holding means comprising means releasably connecting the upper end of the valve member to the tubular member.

4. A tool of the character defined in claim 3, wherein said sealing means comprises seal means about the upper end of the valve member sealably slidable within the tubular member, and seal means on the lower end of the valve member for sealably engaging the passageway in the closed position of the valve member.

* * * * *